US011089924B2

(12) United States Patent
Music

(10) Patent No.: US 11,089,924 B2
(45) Date of Patent: Aug. 17, 2021

(54) TOILET BRUSH CABINET

(71) Applicant: Brenda F. Music, Las Vegas, NV (US)

(72) Inventor: Brenda F. Music, Las Vegas, NV (US)

( * ) Notice: Subject to any disclaimer, the term of this patent is extended or adjusted under 35 U.S.C. 154(b) by 0 days.

(21) Appl. No.: 15/820,402

(22) Filed: Nov. 21, 2017

(65) Prior Publication Data

US 2018/0140144 A1 May 24, 2018

Related U.S. Application Data

(60) Provisional application No. 62/497,515, filed on Nov. 22, 2016.

(51) Int. Cl.
*A47K 17/00* (2006.01)

(52) U.S. Cl.
CPC ..... *A47K 17/00* (2013.01); *A47K 2201/02* (2013.01)

(58) Field of Classification Search
CPC .. A47K 17/00; A47K 17/024; A47K 2201/02; A47K 2010/3233
USPC ..... 312/242, 245, 206, 207, 204
See application file for complete search history.

(56) References Cited

U.S. PATENT DOCUMENTS 1,748,234 A * 2/1930 Loeb ..... E04F 19/08 220/3.4
2,539,838 A * 1/1951 Hurley ..... A47B 67/02 312/206
2,591,172 A * 4/1952 Lundine ..... A47B 47/03 126/39 B
2,673,111 A * 3/1954 Teetor ..... E05C 19/16 292/251.5
2,697,646 A * 12/1954 Craig ..... A47B 81/02 206/361
3,095,249 A * 6/1963 Albrecht ..... A47K 5/02 312/242
3,171,135 A * 3/1965 Polichio ..... A47K 17/00 242/598.5
3,492,037 A * 1/1970 Hutchinson ..... E05C 19/165 292/251.5
3,780,281 A * 12/1973 Ohlhauser ..... A47B 67/005 362/128
4,033,650 A * 7/1977 Alissandratos ..... A46B 5/00 312/206
4,070,074 A * 1/1978 Rohme ..... E05D 3/022 109/70

(Continued)

*Primary Examiner* — Daniel J Troy
*Assistant Examiner* — Timothy M Ayres
(74) *Attorney, Agent, or Firm* — Invention To Patent Services; Alex Hobson

(57) ABSTRACT

A system is provided comprising a recessed, wall-mounted cabinet for sanitary and discreet storage of items and internal flanges along at least one of a top and a bottom interior cabinet edge. The system also comprises external flanges situated around an entire perimeter of the cabinet, a hinged door, and a magnetic latch. The cabinet is mountable in a wall. The cabinet stores cleaning tools and toilet cleaning agents. The cabinet comprises containers for hosting the tools and the agents. The internal flanges promote prevention of the containers from falling from the cabinet. The containers promote prevention of a toilet brush from contacting surfaces of the cabinet. The cabinet is installable with one of right-door and left-door opening capability. The cabinet is constructed from galvanized steel. The galvanized steel does not absorb bacterial and is powder coated.

1 Claim, 7 Drawing Sheets

(56) References Cited

U.S. PATENT DOCUMENTS

| | | | | | |
|---|---|---|---|---|---|
| 4,076,350 | A * | 2/1978 | Crist | E04H 1/1238 | 312/242 |
| 4,915,430 | A * | 4/1990 | Vitale | E05C 1/04 | 292/145 |
| 5,267,786 | A * | 12/1993 | Aisley | A47B 67/02 | 248/468 |
| 5,570,938 | A * | 11/1996 | Butler | A47K 10/22 | 211/59.1 |
| 5,984,100 | A * | 11/1999 | Ramsey | A47K 17/00 | 206/361 |
| 7,156,476 | B2 * | 1/2007 | Helber | A47K 17/00 | 312/242 |
| 8,445,780 | B1 * | 5/2013 | Robins | H02G 3/14 | 174/481 |
| 8,833,876 | B2 * | 9/2014 | Lee | A47G 1/12 | 312/227 |
| 10,342,345 | B1 * | 7/2019 | Farjamrad | A47B 95/008 | |
| 2002/0027402 | A1 * | 3/2002 | Hanser | A47B 96/00 | 312/206 |
| 2006/0119235 | A1 * | 6/2006 | Aisley | A47B 47/00 | 312/242 |
| 2006/0181181 | A1 * | 8/2006 | Calfee | A46B 17/04 | 312/206 |
| 2009/0026900 | A1 * | 1/2009 | DeStefano | A45C 11/00 | 312/242 |
| 2014/0132131 | A1 * | 5/2014 | Thomas | A45C 11/16 | 312/204 |
| 2014/0216957 | A1 * | 8/2014 | Orozco | A47K 17/00 | 206/216 |
| 2016/0045088 | A1 * | 2/2016 | Coleman | A47K 17/00 | 206/349 |

* cited by examiner

TOILET BRUSH CABINET

CROSS-REFERENCE TO RELATED APPLICATIONS

The present Utility patent application claims priority benefit of the U.S. provisional application for patent Ser. No. 62/497,515 entitled "TOILET BRUSH CABINET" filed on 22 Nov. 2016 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a toilet brush cabinet comprising a galvanized rectangular steel box with a steel door on hinges and a magnetic latch. The cabinet is directed to recessed installation into bathroom walls to contain toilet cleaning tools and toilet cleaning chemicals in a discreet and sanitary manner. The cabinet installs flush into a bathroom wall and may be painted the same color as the wall. Interior flanges inside the top and bottom edges of the interior keep contained items from falling out. Interior flanges also may allow for the cabinet to be installed so the door can swing open right or left without need to remove and replace door upon cabinet. The magnetic latch allows for push opening and push closing with any part of the body that is not dirty. The cabinet also includes containers for holding a toilet brush and toilet cleaning agents.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Bathroom cleaning tools and supplies, particularly for a toilet, are unsightly and dirty. Unlike medicines, laundry supplies, and kitchen cleaning supplies, bathroom supplies for the toilet generally do not have dedicated storage. Toilet brushes and containers of toilet cleaning chemicals are typically placed on a bathroom floor near the toilet. This is inherently unsanitary as these items may be situated near a shower, a bathtub, and sink where people wash.

Further, these toilet-cleaning items may be wet, causing a bathroom floor to be slippery. Open storage of these items also creates bacteria risk. In business settings, openly visible toilet-cleaning items are unsightly and create a negative impression about the premises' overall cleanliness and professionalism.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
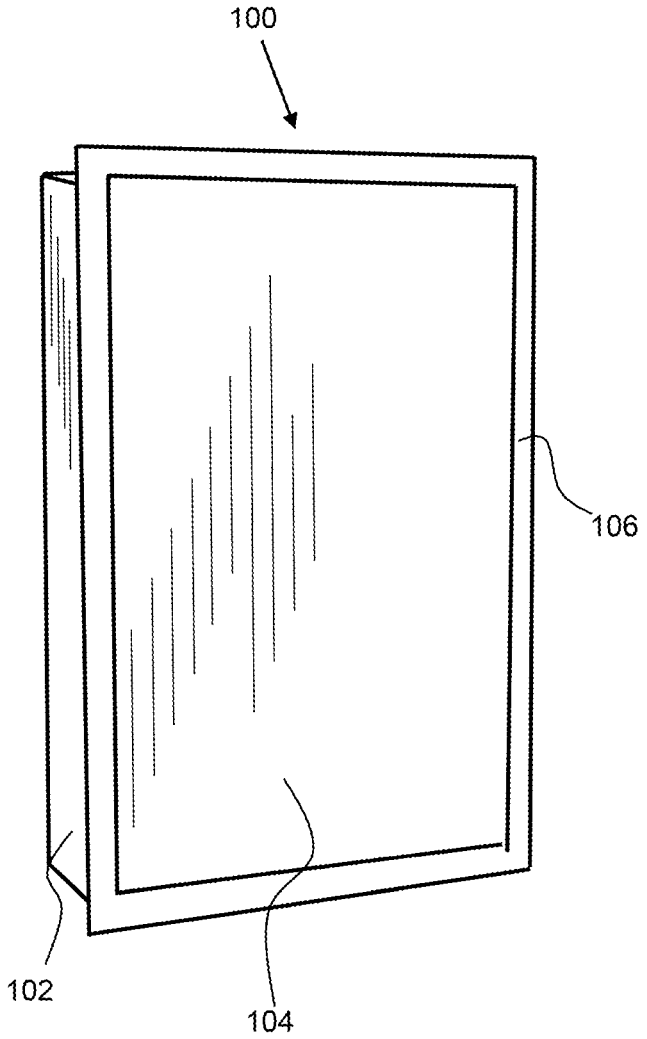
FIG. 1 is a diagram of the toilet brush cabinet in accordance with an embodiment of the present disclosure, the box shown in a front view depicting a flush-mounted door and a flange around entire exterior perimeter of cabinet, the flange about one inch in width.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The present invention will now be described in detail with reference to embodiments thereof as illustrated in the accompanying drawings.

The toilet brush cabinet contains bathroom maintenance tools within a convenient, recessed cabinet that blocks the negative appearance of those tools within its bathroom environment. The toilet brush cabinet is a containing unit with a closing door, specifically for items and products used to clean bathrooms. The cabinet may be flush-mounted into a wall at a strategic location, thus keeping those items nearby for convenient access while also keeping them from visibility in the bathroom.

The unit also may host two separate containers, one for hosting a toilet brush and another for hosting cleaning supplies, which prevent those items from making direct and unsanitary contact with surfaces of the cabinet while stored.

The toilet brush cabinet features an extending flange about the entire perimeter of the cabinet. The cabinet also includes interior flanges upon the top and bottom edges of the cabinet, and a hinged door that closes the cabinet. A spring-loaded magnetic latch is featured to maintain the door in a closed position when needed.

Two containers, each for hosting of cleaning items within the cabinet, are also featured. The toilet brush cabinet may store bathroom cleaning supplies, such as but not limited to a toilet brush, cleaning agents, cleaning tools, and air fresheners. The toilet brush cabinet stores bathroom cleaning supplies in a discreet and concealed manner. By hosting cleaning supplies within a hosting wall, the toilet brush cabinet may free floor space within its hosting bathroom which may improve the appearance and safety of mobility in the bathroom.

By hosting cleaning supplies within a cabinet, the toilet brush cabinet may reduce the risk of odors of said cleaning supplies from radiating within a hosting bathroom. By hosting cleaning supplies within a hosting wall, the toilet brush cabinet may reduce the risk of exposing bacteria and germs, which said cleaning supplies may collect, to the hosting bathroom. By reducing the risk of exposing bacteria and germs to the hosting bathroom, the toilet brush cabinet may improve sanitary conditions of the bathroom. By improving the sanitary qualities of a hosting bathroom, the toilet brush cabinet may improve the intended uses and purposes of the bathroom.

By hosting cleaning supplies within a hosting wall, the toilet brush cabinet may eliminate the visibility of said cleaning supplies. By eliminating the visibility of cleaning supplies, the toilet brush cabinet may improve the appearance of its hosting bathroom. By eliminating the visibility of cleaning supplies, the toilet brush cabinet may allow hosting bathrooms to appear nicer, more pleasant, and better decorated.

By including individual containers for hosting of cleaning supplies, the toilet brush cabinet may eliminate risk of contact between its housing unit and said cleaning supplies. By eliminating contact between its housing unit and its hosted cleaning supplies, the toilet brush cabinet may ensure that said housing unit maintains clean, sanitary status.

The individual containers within the toilet brush cabinet may prevent a toilet brush from directly contacting the housing unit. The individual containers within the toilet brush cabinet may prevent cleaning agents, such as detergents, cleansers and their applicating brushes and sponges, from directly contacting the housing unit.

By preventing such contact between the housing unit and those items within these individual containers, the toilet brush cabinet may be reduced in need for its own cleaning. The toilet brush cabinet can be positioned to allow its door to open from the right or left side. The door portion of the toilet brush cabinet secures by a spring-activated magnetic latch. The door portion of the toilet brush cabinet may be opened with push activation.

A user may open the door of the toilet brush cabinet with a push by hand, elbow, knee or other means. The push activation of the door of the toilet brush cabinet may reduce the need for, and exposure to, user contact with said door. By reducing the need for, and exposure to, user contact with the door, the toilet brush cabinet may eliminate another method by which the housing unit may acquire dirt, germs, and bacteria.

The push activation of the door may allow a user to safely and hygienically open and/or close the toilet brush cabinet even during or after the process of cleaning a bathroom. The toilet brush cabinet includes flanges on the interior area of its top and bottom planes.

The interior flanges of the toilet brush cabinet may secure its hosted items. The interior flanges of the toilet brush cabinet may prevent its hosted items from unintentionally falling out. Featuring a top and bottom interior flange the Toilet Brush Cabinet can be installed with either a left opening or a right opening door simply by appropriately positioning the cabinet during install, and without need to remove and then replace the door.

The extending, exterior flange may cover up imperfections in the cut in the wall that is made to host the cabinet. The toilet brush cabinet can be painted to match the décor of the environment and/or to discreetly blend with its hosting wall.

The toilet brush cabinet can be made in various sizes and shapes. The toilet brush cabinet can be made of various applicable metal materials including steel, galvanized steel, anodized aluminum, and aluminum alloy. The toilet brush cabinet can also be made of various plastic materials of adequate durability such as polyvinyl chloride (PVC) and high-density polyethylene (HDPE). The toilet brush cabinet can also be made of various combinations of metal and plastic materials.

The toilet brush cabinet may be made in formats that include apertures within its sidewalls, and to aid its mounting to wall studs. The interior flanges of the toilet brush cabinet can be of various heights. The extending flange about the perimeter of the toilet brush cabinet can be of various widths.

The toilet brush cabinet can be made in formats that merely attach to a wall instead of recessed placement. The toilet brush cabinet may use various methods to secure its door, including but not limited to spring-loaded magnetic latch, rotating lever and other means.

The separate containers of the toilet brush cabinet may be made in various sizes and shapes that accommodate their intended purposes. The separate containers of the toilet brush cabinet may be made of various materials of adequate durability, including but not limited to polyvinyl chloride (PVC) and high-density polyethylene (HDPE).

The toilet brush cabinet may be made in variations that are sized to accommodate hosting of a plunger. In such variations, a separate container for hosting the plunger may also be included. The toilet brush cabinet may or may not be produced in variations that feature shelving.

The base unit of the toilet brush cabinet is made of galvanized steel and in a rectangular shape by stamping, and measures approximately twenty-four inches in height by fourteen and one-half inches in width by five inches in depth (24"×14½"×5"). The back plane of this base unit is permanently closed.

From both the top and bottom widths, and on the side of the open plane of the base unit, interior flanges of an approximate one-inch (1") height project. An exterior flange of one-inch (1") width is featured about the perimeter, and on the side of the open plane of the base unit.

A door applies to one length-wall of the side of the open plane, and to seal that open plane when said door is closed. This door applies to the base unit by interior hinges. On the opposite length-wall, and positioned at center-height, is a spring-loaded magnetic latch, which contacts a corresponding metal plate upon the interior side of the door and holds the door when in a closed position.

A hollow rectangular column, made of polyvinyl chloride (PVC), measures approximately four and one-half inches in width by four and one-half inches in length by eight inches in height (4½"×4½"×8"), and hosts a toilet brush. A second hollow rectangular column, also made of polyvinyl chloride (PVC), measures approximately four and one-half inches in width by six inches in length by four inches in height (4½"×6"×4½"), and for hosting various bathroom cleaning/freshening accessories such as toilet bowl cleaner.

After choosing a strategic location, an area of approximately twenty inches in length by fourteen and one-half inches in width (20"×14½") may be cut into a wall. The toilet brush cabinet may then be inserted and mounted within this area, with the bordering flange contacting the surrounding wall area. Screws, nails and/or adhesives can be used to secure the cabinet in place.

A toilet brush can be inserted within its hosting container, cleaning materials may be included within the remaining hosting container, and both containers may be placed within the cabinet. When cleaning materials and/or toilet brush are needed, a user may simply depress the door. The door will be released by the spring-loaded magnetic latch.

FIG. 1 is a diagram of the toilet brush cabinet in accordance with an embodiment of the present disclosure, the cabinet shown in a front view depicting a flush-mounted door and a flange around entire exterior perimeter of cabinet, the flange about one inch in diameter. Depicted in FIG. 1 are a chamber portion 102, a door 104, and external flange 106. The chamber portion 102 is the body or containing portion of the cabinet. The door 104 is depicted in closed position. As discussed, the external flange 106 wraps around the full perimeter of the cabinet. (The number 100 is used at top of image but not cited in this paragraph.)

Figure 2:
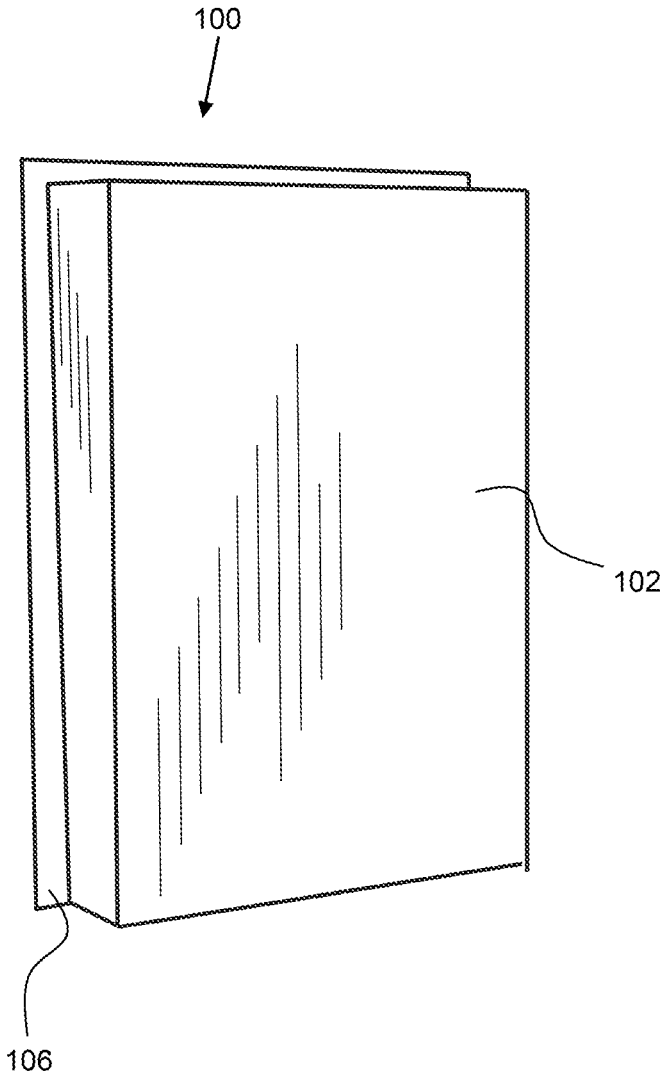
FIG. 2 is a diagram of the toilet brush cabinet in accordance with an embodiment of the present disclosure, the box shown in a rear view depicting the flange around entire exterior perimeter of cabinet, the flange about one inch in width.

FIG. 2 is a diagram of the toilet brush cabinet in accordance with an embodiment of the present disclosure, the cabinet shown in a rear view. The external flange 106 is depicted around entire exterior perimeter of cabinet. The external flange 106 may be about one inch in width. (The number 100 is used at top of image but not cited in this paragraph.)

Figure 3:
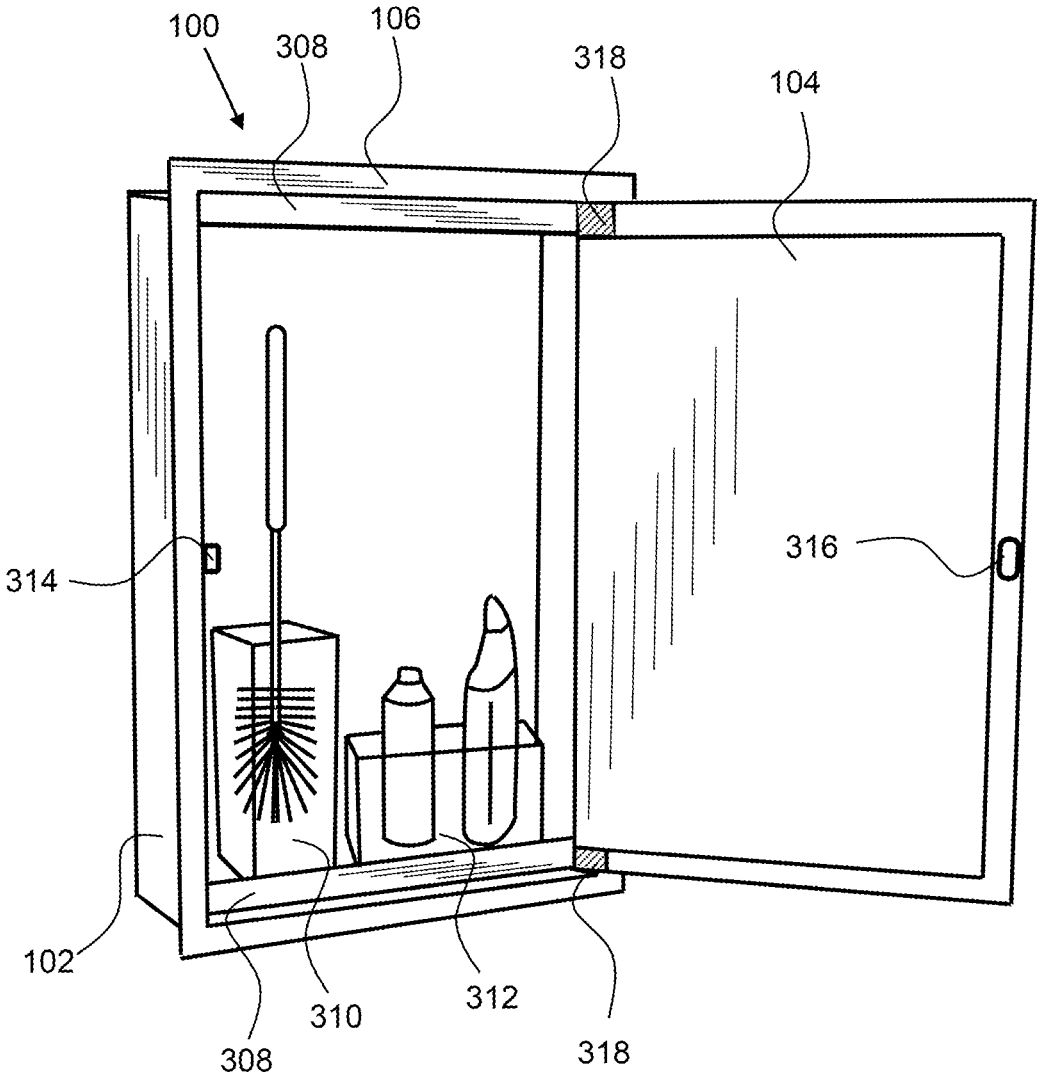
FIG. 3 is a diagram of the toilet brush cabinet in accordance with an embodiment of the present disclosure, depicting a front view of the cabinet with the door of the cabinet in an open position and further depicting a spring-loaded magnet latch, a metal plate for the magnetic latch, and recessed and partially hidden door hinges.

FIG. 3 is a diagram of the toilet brush cabinet in accordance with an embodiment of the present disclosure, depicting a front view of the cabinet with the door 104 of the cabinet in an open position. Depicted in FIG. 3 are the chamber portion 102, the door 104, and the external flange 106. Internal flanges 308 are shown as are a toilet brush container 310 and a cleaning agents container 312. Further depicted are a spring-loaded magnet latch 314, a metal plate for the magnetic latch 316, and recessed and partially hidden door hinges 318. (The number 100 is used at top of image but not cited in this paragraph.)

Figure 4:
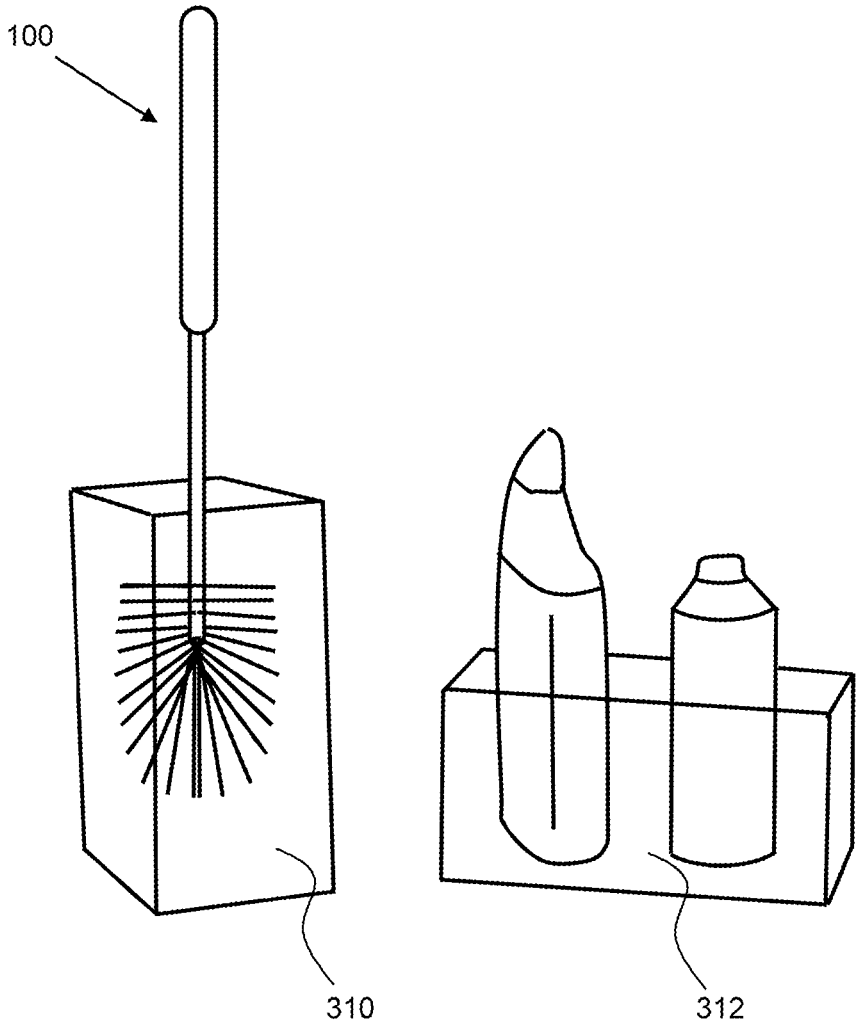
FIG. 4 is a diagram of a toilet brush container and container for cleaning supplies and/or air freshener for storage in the cabinet in accordance with an embodiment of the present disclosure, the containers holding exemplary toilet brush, exemplary toilet cleaner liquid, and exemplary air freshener, and the toilet brush container also exhibiting a container lid.

FIG. 4 is a diagram of a toilet brush container 310 and container 312 for cleaning supplies and/or air freshener for storage in the cabinet in accordance with an embodiment of the present disclosure. The toilet brush container 310 holds is depicted holding an exemplary toilet brush. The container 312 is depicted holding an exemplary toilet cleaner liquid, and exemplary air freshener. The toilet brush container 310 is depicted with a container lid. (The number 100 is used at top of image but not cited in this paragraph. I think number 100 is supposed to be the actual cabinet. If that is accurate it shouldn't be included here.)

Figure 5:
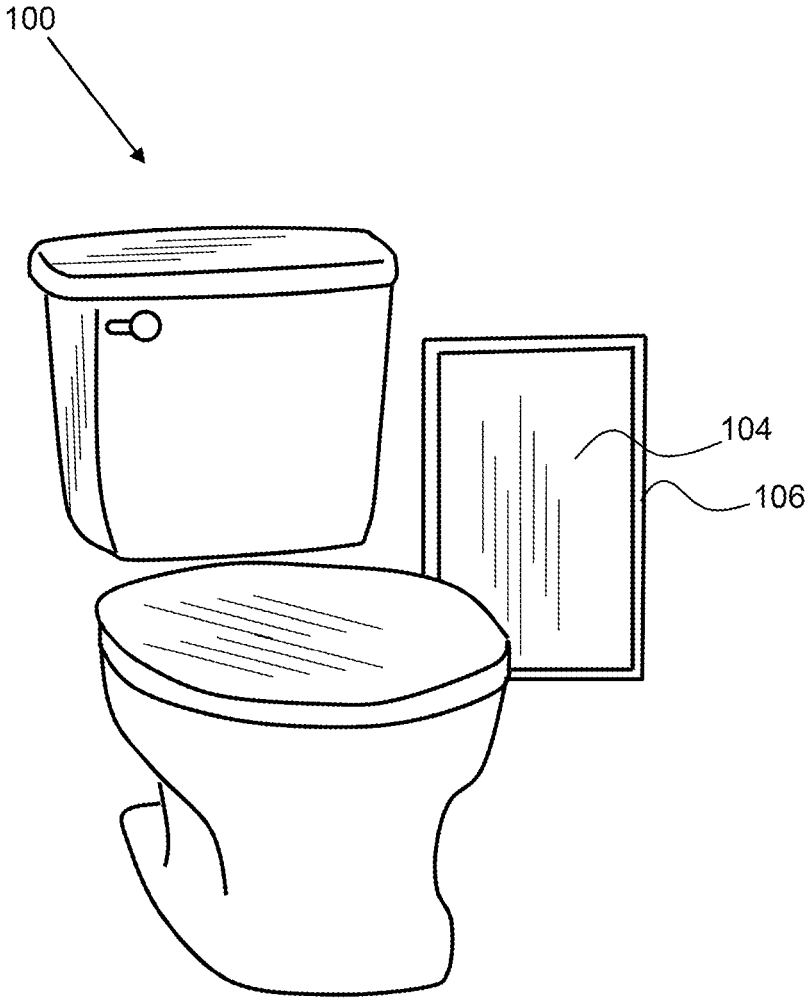
FIG. 5 is a diagram of the toilet brush cabinet in accordance with an embodiment of the present disclosure with the cabinet depicted as fully installed in a bathroom near a toilet and the door of the cabinet in a closed position.

FIG. 5 is a diagram of the toilet brush cabinet in accordance with an embodiment of the present disclosure with the cabinet depicted as fully installed in a bathroom near a toilet and the door 104 of the cabinet in a closed position. As discussed, the cabinet is installed near the toilet so the cabinet's contents may be reached quickly, perhaps in an emergency. With the door 104 closed, the cabinet may be discreet and not easily noticed. (The number 100 is used at top of image but not cited in this paragraph.)

Figure 6:
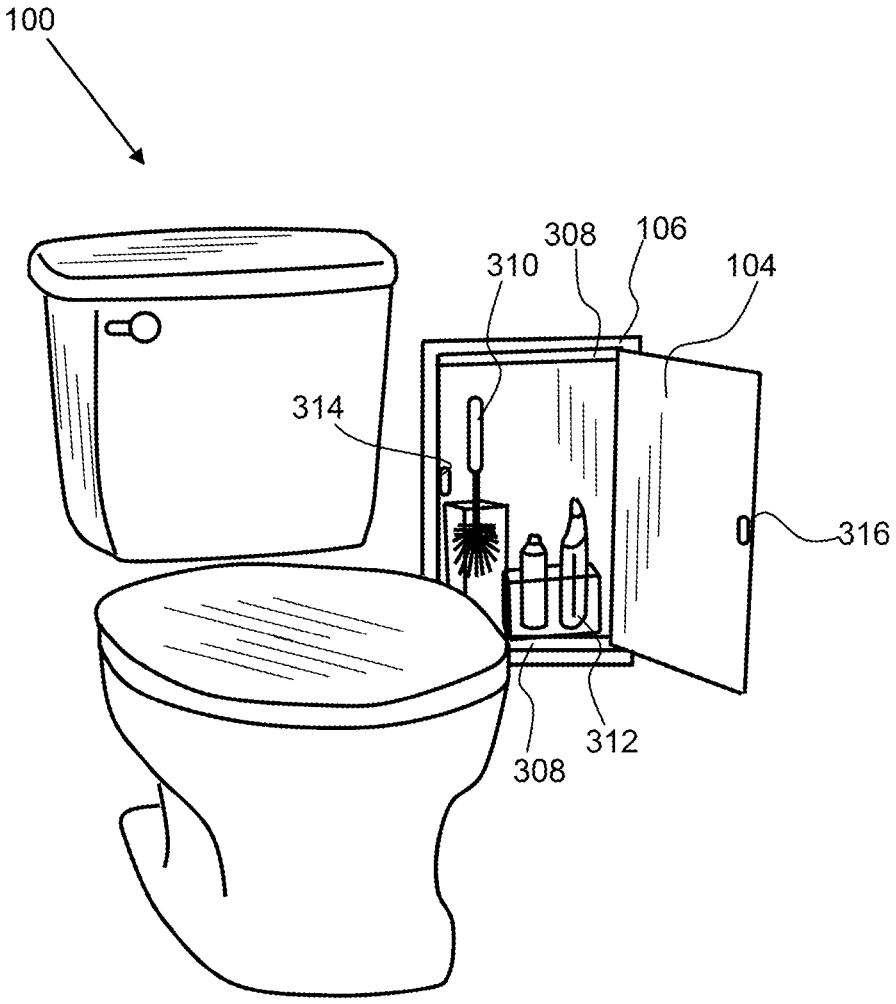
FIG. 6 is a diagram of the toilet brush cabinet in accordance with an embodiment of the present disclosure with the cabinet depicted as fully installed in a bathroom near a toilet and the door of the cabinet in an open position.

FIG. 6 is a diagram of the toilet brush cabinet in accordance with an embodiment of the present disclosure with the cabinet depicted as fully installed in a bathroom near a toilet and the door 104 of the cabinet in an open position. Depicted in FIG. 6 are the door 104 and the external flange 106. Internal flanges 308 are shown as are the toilet brush container 310 and the cleaning agents container 312, Further depicted are the spring-loaded magnet latch 314 and the metal plate for the magnetic latch 316. (The number 100 is used at top of image but not cited in this paragraph.)

Figure 7:
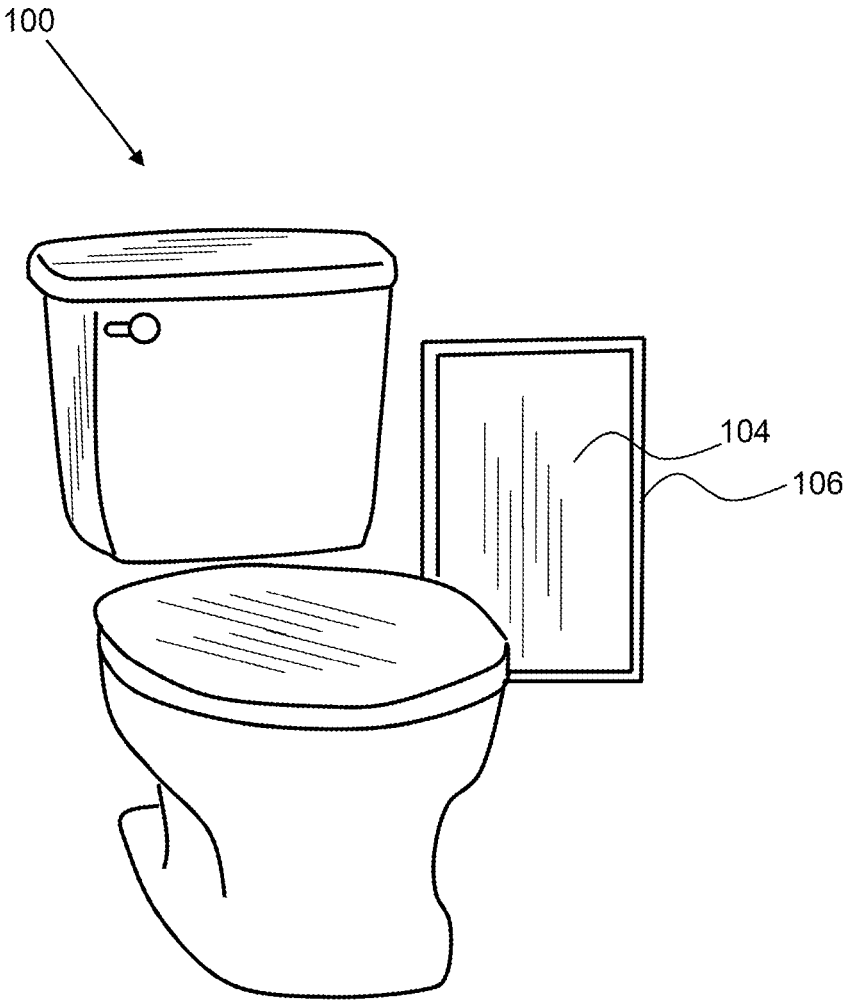
FIG. 7 is a diagram of the toilet brush cabinet in accordance with an embodiment of the present disclosure with the cabinet depicted as fully installed in a bathroom near a toilet and the cabinet painted in a manner to match the wall of the bathroom, which may help keep the cabinet from being noticeable.

FIG. 7 is a diagram of the toilet brush cabinet in accordance with an embodiment of the present disclosure with the cabinet depicted as fully installed in a bathroom near a toilet and the cabinet painted in a manner to match the wall of the bathroom, which may help keep the cabinet from being noticeable. Depicted in FIG. 7 are the door 104 in closed position and the external flange 106. (The number 100 is used at top of image but not cited in this paragraph.)

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a design for a toilet brush cabinet more effectively according to the present invention will be apparent to those skilled in the art. Various aspects of the invention have been described above by way of illustration, and the specific embodiments disclosed are not intended to limit the invention to the particular forms disclosed. The particular implementation of the design for the toilet brush cabinet may vary depending upon the particular context or application. By way of example, and not limitation, systems and methods of the toilet brush cabinet and its use may lend itself, however, to similar techniques that may instead be applied to any type of container use and storage. Such implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A system consisting of:

a recessed, wall-mounted cabinet for sanitary and discreet storage of items;

a chamber portion, wherein said chamber portion is a containing portion of said recessed, wall-mounted cabinet, and wherein said chamber portion is configured to be disposed inside a recessed portion of a wall section; and wherein said chamber portion has an opening for insertion of said items;

a first internal flange comprising a first internal flange and a second internal flange, said first internal flange extending across an entire top edge portion of the opening along an interior of said chamber portion and said second internal flange extending across an entire bottom edge portion of the opening along said interior of said chamber portion, wherein said interior flange is configured to allow a reversible installation of said recessed, wall-mounted cabinet;

an external flange that extends around an entire outer perimeter of said recessed, wall-mounted cabinet, wherein said external flange is configured to rest flush against a wall surface with the chamber portion recessed in said wall section;

a door configured over an opening to said chamber portion, said door comprising door hinges coupled with the chamber portion to allow said door to swing open from said opening to said chamber portion; wherein said interior flange is further configured to allow for said door to swing open right when said first internal flange is disposed on a top portion of said chamber portion, and wherein said internal flange is further configured to allow for said hinged door section to swing open left when said second internal flange is disposed on the top portion of the chamber portion; and a magnetic latch coupled to said door, a spring-loaded magnet latch coupled to the chamber portion and configured to allow for push opening or push closing of said door;

a first container for hosting a toilet brush and a second container for hosting toilet cleaning agents;

whereby said first internal flange and said second internal flange are configured to prevent the first container and second containers from falling from said chamber portion regardless of mounting orientation; and whereby said recessed, wall-mounted cabinet is flush-mountable to a wall surface whereby the first container prevents said toilet brush from contacting surfaces of said recessed, wall-mounted cabinet, whereby said recessed, wall-mounted cabinet is installable with one of right-door and left-door opening capability, and whereby said recessed, wall-mounted cabinet is constructed from at least one of anodized aluminum, aluminum alloy, and plastic.

* * * * *